United States Patent [19]

Over et al.

[11] 4,097,106

[45] Jun. 27, 1978

[54] TERMINAL HOUSING HAVING AN INTEGRAL STRAIN RELIEF

[75] Inventors: William Roderick Over, Harrisburg; Joseph Agusta Wise, Mechanicsburg, both of Pa.

[73] Assignee: AMP Incorporated, Harrisburg, Pa.

[21] Appl. No.: 565,283

[22] Filed: Apr. 4, 1975

[51] Int. Cl.[2] ..... H01R 13/38

[52] U.S. Cl. ..... 339/99 R; 174/135; 339/102 R

[58] Field of Search ..... 339/97–99, 339/102, 103, 276; 174/135; 336/192

[56] References Cited

U.S. PATENT DOCUMENTS

| | | | |
|---|---|---|---|
| 1,984,036 | 12/1934 | Schwartzmann | 336/192 |
| 2,806,214 | 9/1957 | Forney, Jr. | 339/276 T |
| 2,999,962 | 9/1961 | Wahl | 336/192 |
| 3,668,615 | 6/1972 | Bury | 339/276 T |
| 3,777,302 | 12/1973 | Travis | 339/223 R |
| 3,860,318 | 1/1975 | Reavis, Jr. et al. | 339/99 R |

*Primary Examiner*—Joseph H. McGlynn
*Attorney, Agent, or Firm*—Allan B. Osborne

[57] ABSTRACT

The present invention relates to a housing of insulating material adapted to accommodate an electrical terminal and having a strain relief member adapted to be crimped into an encompassing engagement around the wire terminated to the terminal therein. More particularly, the strain relief member consists of a pair of vertical walls which are crimped inwardly and downwardly to mechanically grip the outer insulating jacket of the wire.

4 Claims, 2 Drawing Figures

TERMINAL HOUSING HAVING AN INTEGRAL STRAIN RELIEF

BACKGROUND OF THE INVENTION

Generally speaking a terminated wire requires some kind of support whereby any force or strain applied to the wire is absorbed at some point other than at the connection between the terminal and wire so that the electrical contact is preserved.

Prior art terminals of the type having an open or closed wire barrel which is crimped around the wire have a wire insulation support barrel at one end. This barrel is crimped around the outer insulating jacket and provides the strain relief for the terminal.

More recently, terminals employing slotted beams as a means of electrically terminating the wire have entered the market place. Termination occurs by pushing a wire down between the beams. The edges cut through the outer insulation and make electrical contact with the conductor. Although wire insulation support barrels may constitute one end of such slotted beam terminals, the omission thereof results in an economical advantage in that there is a cost savings in material, stamping and forming operations and in plating. Stamping and forming dies are less complicated and tend to have a longer useful life.

Strain relief means are necessary however. Accordingly the housing, constructed in accordance with the present invention, in which the terminals are positioned, have as a chemical unitary part thereof strain relief means which are crimped into encompassing engagement around the outer insulating jacket of the wires terminated therein.

DESCRIPTION OF THE PREFERRED EMBODIMENT

Figure 1:
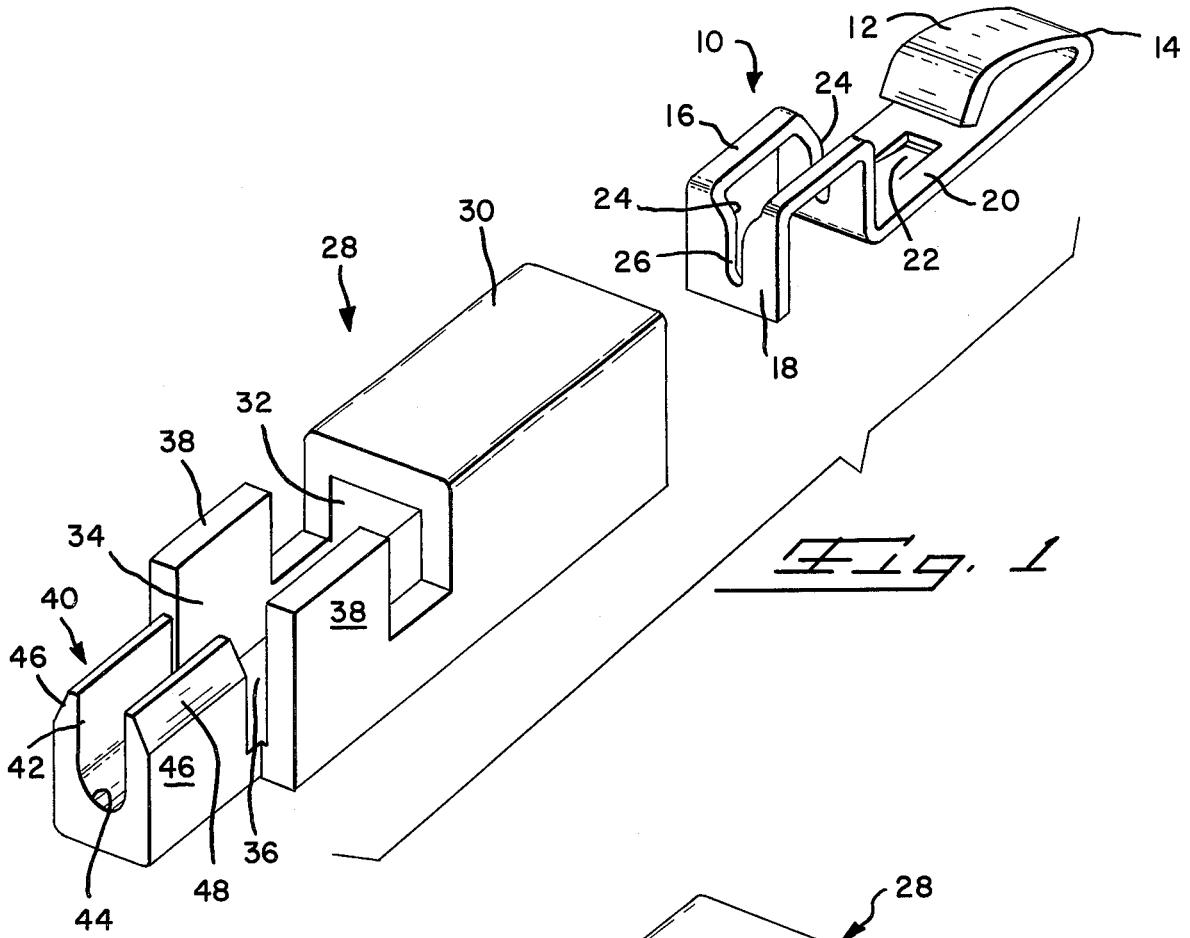
FIG. 1 is a perspective view of the slotted beam terminal and the housing, constructed in accordance with the principles of the present invention, having as an integral part thereof, a strain relief member.

A slotted beam terminal 10, lying to the right in FIG. 1 consists basically of a leaf contact portion 12 at the front end 14, a double slotted beam 16 at the rear end 18 and a connecting strap 20 between. A retaining tine 22 may be blanked out of strap 20 as shown.

Terminating a wire in a slotted beam terminal involves simply pushing the wire (shown in FIG. 2) down slots 24 positioned in beam 16. The edges 26 of the slots cut through the insulation and make electrical contact with the conductor.

Housing 28, seen lying to the left in FIG. 1, is molded from the plastic material polysulfone which has the property of being very stable. This property permits the material to be cold formed as will be discussed below.

The front portion 30 contains a leaf contact retaining passageway 32 which is opened at the front face of the housing (not shown) to receive therein a mating terminal (not shown).

Unitary with and positioned immediately behind the front portion 30 is the slotted beam receiving cavity 34.

This cavity is defined by a floor 36 which is a continuation of the floor of passageway 32, and by a pair of sidewalls 38 rising up from either side of the floor.

A strain relief member 40 having a channel 42 therethrough extends rearwardly from cavity 34 and is a unitary part of housing 28 as is the cavity and front portion 30.

The term chemical unitary or simply unitary is used throughout in the sense that the front portion 30 and the strain relief member 40 are molded from the same material, in the same mold and that there is no physical or chemical separations, changes or the like from one to the other.

The floor 44 of the channel is preferably curved as shown in FIG. 1 and is above the level of floor 36 and 32. Two sidewalls 46 project upwardly from either side of the floor. The upper section of each sidewall is beveled inwardly in an upward direction as generally indicated by reference number 48. Dimensionally the curvature of the floor approximately equates to the diameter of the wire being crimped therein.

Figure 2:
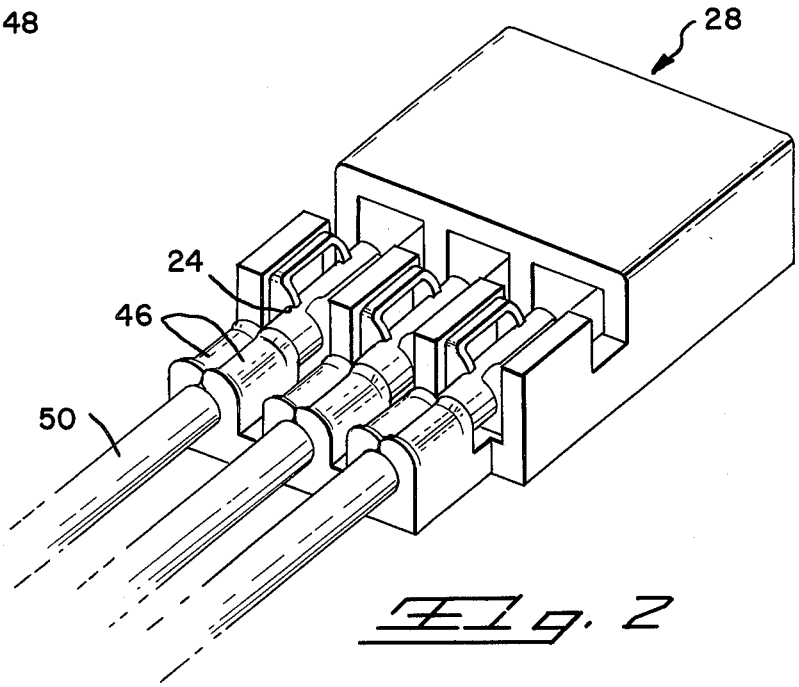
FIG. 2 illustrates basically the housing of FIG. 1 but having multiple strain relief members. The view further demonstrates the strain relief member crimped about the outer insulating jackets of the wires terminated in the slotted beam terminals positioned in the housing.

The utilization of the housing constructed in accordance with the present invention is shown in FIG. 2. The housing differs from that in FIG. 1 in that it has been molded to accept three terminated wires.

Loading housing 28 with terminals 10 and terminating wires therein can be done completely by hand, completely by machine or partly by both methods. In any event, a terminal 10 is staked into passageway 32 via retaining tine 22. A wire 50, which may be insulated, is pressed down slots 24, edges 26 thereof cutting into the conductor and making electrical contact. With the wire 50 lying in channel 42, sidewalls 46 are crimped or otherwise folded inwardly and downwardly into encompassing engagement with the wire as shown.

The crimped sidewalls 46 remain so formed, providing a non-metallic, suitable strain relief member. The forces required are considerably less than what would be required in crimping a metal strain relief member with no difference in results obtained.

The foregoing detailed description has been given for clearness of understanding only, and no unnecessary limitations should be understood therefrom, as some modifications will be obvious to those skilled in the art.

What is claimed is:

1. A housing for an electrical terminal, which comprises:

a. a housing of non-conductive material having a passageway for receiving the contact portion of the electrical terminal and a cavity axially positioned behind the passageway for receiving the wire engaging means of the electrical terminal; and b. a strain relief member unitary with and of the same non-conductive material as the housing and axially positioned behind the cavity, said strain relief member having a channel therethrough for receiving the wire which may be connected to the terminal with the sidewalls of the channel adapted to be cold-formed around the wire in retaining engagement therewith.

2. The housing of claim 1 wherein said material is polysulfone.

3. An electrical connector, comprising:

a. a chemically unitary molded housing of insulating material having at one end a front portion containing a passageway therethrough and at another end a strain relief member having a floor and sidewalls extending upwardly from either side of the floor, said sidewalls capable of being crimped into a permanent, encompassing relation about an electrical wire which may be positioned in the strain relief member, further said housing having a receiving cavity between and connecting the front portion and strain relief member; and b. a terminal of conductive material having at one end contact means adapted for engagement with another electrical connecting device and at the other end a wire terminating slotted beam section, said terminal positioned in the housing with the contact means at least partially positioned in the passageway and the slotted beam section positioned in the receiving cavity.

4. An electrical connection, comprising:

a. a unitarily molded housing of insulating material having at one end a front portion containing a passageway therethrough and at another end a strain relief member having a floor and sidewalls extending upwardly from either side of the floor, further said housing having a receiving cavity between and connecting the front portion and the strain relief member;

b. a stamped and formed terminal of conductive material having at one end contact means adapted for engagement with another electrical connecting device and at the other end a wire terminating slotted beam section, said terminal positioned in the housing with the contact means at least partially positioned in the passageway and the slotted beam section positioned in the receiving cavity; and c. an electrical wire having an outer insulating jacket and a center conductor with an end of the wire terminated in the slotted beam section and a portion of the wire lying on the floor of the strain relief member with the sidewalls thereof crimped in a permanent encompassing relation thereby mechanically gripping the wire.

* * * * *